US006216869B1

(12) United States Patent
Zhang

(10) Patent No.: US 6,216,869 B1
(45) Date of Patent: Apr. 17, 2001

(54) FLASH CARD MANAGEMENT APPARATUS

(76) Inventor: Li Feng Zhang, 265 W. 22nd Pl., Chicago, IL (US) 60616

( * ) Notice: Subject to any disclaimer, the term of this patent is extended or adjusted under 35 U.S.C. 154(b) by 0 days.

(21) Appl. No.: 09/266,311

(22) Filed: Mar. 11, 1999

(51) Int. Cl.[7] ..... B65D 85/00

(52) U.S. Cl. ..... 206/425; 206/315.1; 206/561; 211/50; 220/532; 220/536

(58) Field of Search ..... 206/315.1, 214, 206/224, 425, 449, 555, 561; 220/507, 529, 530, 532–534, 536; 211/50, 41.1

(56) References Cited

U.S. PATENT DOCUMENTS 1,552,519 * 9/1925 Ulrich ..... 220/535
1,739,730 * 12/1929 Orthwine ..... 206/561
2,261,840 * 11/1941 Bergmann ..... 220/532
4,940,156 * 7/1990 Cote et al. ..... 220/533
5,148,942 * 9/1992 Snook ..... 206/425
5,215,205 * 6/1993 Behlman ..... 220/533
5,265,729 * 11/1993 Carlin ..... 206/561
5,938,028 * 8/1999 Hu ..... 206/377

* cited by examiner

*Primary Examiner*—Luan K. Bui
(74) *Attorney, Agent, or Firm*—Joan I. Norek; The Law Office of Joan I. Norek

(57) ABSTRACT

A flash card management apparatus has a progression of compartments that govern or direct which cards are reviewed at a given drill session. When the progression is ordered by card capacities, a given card will come up for review possibly at each drill session for the first few sessions, and then come up for review with ever decreasing frequency thereafter. The use of the management apparatus will assure that each card will be not only periodically reviewed, but also reviewed a fixed number of times before it is put on the side.

18 Claims, 4 Drawing Sheets

FLASH CARD MANAGEMENT APPARATUS

BACKGROUND OF THE INVENTION

Lexical education, instruction, practice and/or drilling typically involves the use of vocabulary cards. Vocabulary cards are often similar to playing cards, that is, they are flat, only slightly flexible pieces of paper or thin paperboard, often rectangular in shape. Typically a word among those being learned is displayed on one side of the vocabulary card, and on the opposite side is displayed (1) its meaning and/or translation, (2) its pronunciation guides or symbols, and/or possibly (3) other assistive information, such as a drawing depicting the word, use examples, variant spellings, the word's part of speech (noun, verb, adjective, adverb, pronoun and the like), other functional designations and the like. A student drills and/or tests his or her ability to identify the words on a group or battery of cards one at a time, flipping the card over to check his or her answer or to determine the correct answer.

Vocabulary cards are an educational aid of the generic type commonly referred to as flash cards. Flash cards are or can be used in many educational fields. Their use is well known in the teaching of mathematics, and are or can be used for history (for example, events versus their dates or principal participants), geography (for example, states versus their capital cities), science (for example, elements versus periodic table information) and so forth. The potential uses of flash cards is virtually unlimited. They can be used as an aid to mastering almost any educative and/or instructive field that requires the acquiring of new information and/or knowledge.

The study of a language foreign to a person's native language normally requires the mastery (through memorization or other learning techniques) of hundreds or thousands of words. Conventional reading and/or vocabulary lessons for school children might also require the drilling of hundreds of words. In either situation, words that have been studied once normally must be reviewed periodically. When flash cards are used, the cards requiring periodic review can quickly become so numerous that their management is unwieldy and cumbersome. There are too many cards for a complete review in a single time period, and a systematic review during multiple time periods approaches being impossible without an effective organization of the cards. Further, if the organization task is time-consuming, or even just boring, the learning process is negatively impacted.

BRIEF SUMMARY OF THE INVENTION

The present invention is a flash card management apparatus having a progression of compartments that govern or direct which cards are reviewed at a given drill session. When the progression is ordered by card capacities, a given card will come up for review possibly at each drill session for the first few sessions, and then come up for review with ever decreasing frequency thereafter. The use of the management apparatus will assure that each card will be not only periodically reviewed, but also reviewed a fixed number of times before it is put on the side. No matter how numerous the cards, their management is not unwieldy or cumbersome. When there are too many flash cards for a complete review in a single time period, the present invention's management apparatus permits a systematic review during multiple time periods. Further, when the management apparatus is used, the organization of the cards is not time-consuming, nor particularly boring.

The present invention also provides a learning drill session method that employs the management apparatus.

DETAILED DESCRIPTION OF THE INVENTION

Figure 1:
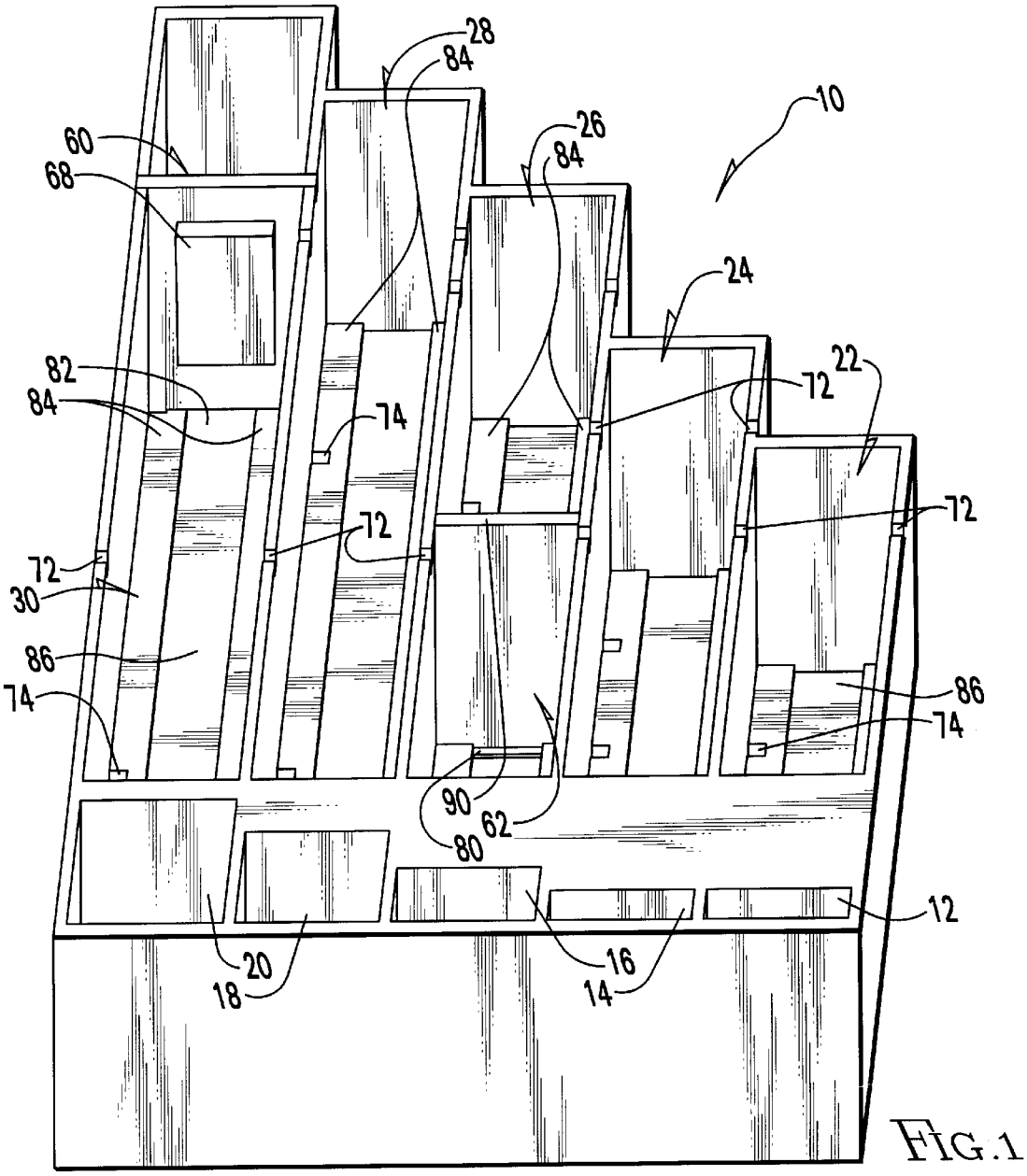
FIG. 1 is a perspective view of a flash card management apparatus of the invention.

In FIG. 1 there is shown a flash card management apparatus 10 of the present invention with some components removed for clarity of description. The management apparatus has plurality of flash card compartments, namely compartments 12, 14, 16, 18, 20, 22, 24, 26, 28 and 30. As ordered or arranged in this embodiment, five of these ten flash card compartments, namely compartment 12 through compartment 18, are aligned side by side at the front of the management side behind the front alignment of compartments. All of the compartments, except compartment 12 and compartment 14, are provided with a first and a second partition 60, 62 (shown respectively only in compartment 26 and compartment 30), which will be discussed in detail below.

When taken from right to left and front alignment before the rear alignment, the compartments form (with one exception) an arrangement of progressively longer compartments. For instance, compartment 30 is longer than compartment 28, which is longer than compartment 26, and so forth. The exception is that compartment 12 and compartment 14 are each of substantially the same length (which feature is discussed below). The compartments are of substantially the same height and width, forming a vertical profile or configuration suited to holding, storing and/or accommodating flash cards in an "on end" or upright position. Each compartments is of sufficient length to hold more than one flash card, and most are designed to hold many cards. When flash cards of substantially uniform thickness are used, the longer a compartment, the more cards it can hold. In actuality, the flash cards in each compartment of the management apparatus 10 as shown will be held between the first and second partitions 60, 62 (except compartment 12 and compartment 14). Partitions 60, 62 define the effective lengths, or maximum effective lengths, of each compartment, but for simplicity of explanation the compartments of FIG. 1 will be described first substantially without reference to the partitions 60, 62 and without the flash cards being shown. The management apparatus 10 thus includes a series of flash card compartments arranged by progressively higher flash card capacities. When the flash cards that are placed into (or stored in) a compartment reach the capacity of that compartment, some of the flash cards will be pushed onto the foot or retainer component 80 of the second partition 62 (or hoisting partition) for removal from the compartment as described later below. The second or hoisting partition 62 and its immediately surrounding area can be considered an "outlet" of the compartment as described later below.

Figure 2:
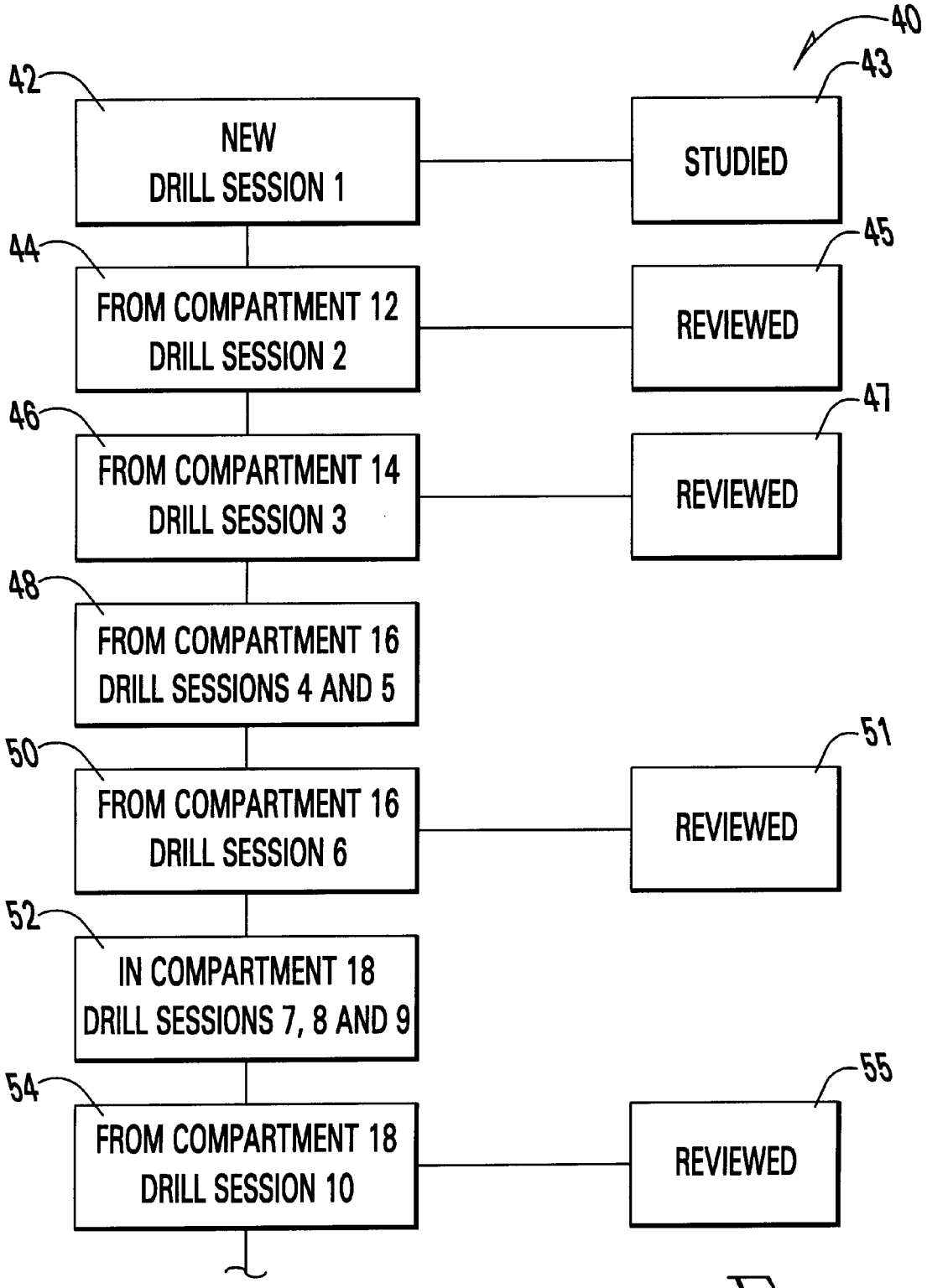
FIG. 2 is a partial flow diagram of the management of a set of flash cards over the first eight drill sessions using the management apparatus of FIG. 1.

In simple exemplitive overview, the flash cards that will be reviewed during a drilling session will be the cards removed from any of the compartments via their hoisting partitions 62, plus the cards already in compartments 14 and 12. In addition to such reviews, a new group or set of cards will be studied for the first time. For example, assuming that (a) there are some flash cards in all compartments up to at least 30, (b) there are flash cards ready to be removed via the hoisting partition 62 in compartment 16 through compartment 28 (which, as seen from this example, is a condition that will be seen if there are some flash cards in compartment 30 but not enough to reach its capacity), and (c) the number of flash cards that are newly introduced at a drill session are the same number of cards that are set for removal from any of the compartments. The student starts the review drill using the flash cards that are removed from compartment 28. When these flash cards are drilled, they are placed into the compartment of sequential greater length, which is compartment 30. The flash cards are placed in compartment 30 at the end of the line of cards opposite the outlet of compartment 30. (The cards are put into compartment 30 adjacent its first partition 60 which is discussed below.) Then the flash cards that are removed from compartment 26 are drilled and returned to the management apparatus 10, placing them in compartment 28. In the same manner, the flash cards that are removed from compartment 24 are drilled and returned to the management apparatus 10, placing them in compartment 26, and so forth until the flash cards in compartment 16 that are removed are drilled and placed into compartment 18. Then all of the cards in compartment 14 are drilled and placed into compartment 16. All of the cards in compartment 12 are drilled, and placed into compartment 14. New cards are then studied, and placed into compartment 12. In this exemplitive use of the management apparatus 10, all of the flash cards in a set of new cards are studied at one drill session and then reviewed at each of the next two drill sessions when they are respectively the flash cards of compartment 12 and compartment 14. If the capacities of compartment 16 and compartment 18 are respectively twice and thrice that of compartment 12 or compartment 14, they will be reviewed twice more during the next five drill sessions. This sequence is shown in FIG. 2, which is a partial flow diagram 40 of the management of a set of flash cards over the first eight drill sessions. In FIG. 2 the location stations are aligned vertically on the left and the operation stations are aligned vertically on the right. At the first drill session, this hypothetical set of flash cards is introduced for the first time. The introduction of these flash cards during the first drill session is shown at location station 42, and the operation thereon, namely being studied, is shown at operation station 43. At the second and third drill sessions, these flash cards are taken out of compartment 12 and compartment 14 respectively, as indicated at location station 44 and location station 46, and reviewed as indicated at operation station 45 and operation station 47 respectively. At the next two drill session, which are the fourth and fifth drill sessions, these flash cards are not reviewed, but instead remain in compartment 16 as indicated at location station 48 because they are behind other flash cards that entered the sequence earlier. At the sixth drill session these flash cards are in the position of being removed from compartment 16, and thus are taken from compartment 16 as indicated at location station 50 and reviewed as indicated at operation station 51. Over the next three drill sessions, namely the seventh, eighth and ninth drill sessions, these flash cards are not reviewed, but instead remain in compartment 18 as indicated at operation station 52 because they are behind other flash cards in compartment 18 that entered the sequence earlier. At the tenth drill session these flash cards are in the position of being removed from compartment 18, and thus are taken from compartment 18 as indicated at location station 54 and reviewed as indicated at operation station 55. These flash cards then are placed into compartment 20, behind the flash cards already in compartment 20, and so the succession continues.

Since there are ten compartments comprising the management apparatus 10, each flash card introduced will be studied once and then reviewed ten times before being removed from the sequence. As a card progresses through the compartments of the management apparatus 10, the time delay between reviews increases.

It will also be seen from this example that there will be an incipient period before a steady state is reached. The incipient period begins with no cards in any of the compartments at the very first drill session. At this very first drill session a group of new cards are studied and no cards are reviewed. Using the flow diagram of FIG. 2 as a guide, it is seen that at the beginning of the incipient period, there will be no cards waiting for review in compartment 12 until drill session two, and therefore the review of cards from compartment 12 begins on drill session two. Similarly, there will be no cards waiting for review in compartment 14 until drill session three, and therefore the review of cards from compartment 14 begins on drill session three. Similarly, if compartment 16 has a capacity for three sets of cards, the review of cards from compartment 16 only begins on drill session six because the cards placed into compartment 16 after drill session three are not removed for review during either drill session four or five. And so forth.

Compartment 12 and compartment 14 are referred to hereinafter as the inaugural compartments of management apparatus 10. They hold only a single set of flash cards and all the flash cards in compartments 12 and 14 are reviewed and moved on to the next compartment at each drill session. Compartment 12 holds the flash cards that were studied for the first time at the prior drill session. Compartment 14 hold the flash cards that were studied for the first time two drill sessions earlier and then were reviewed at the prior drill session.

Compartments 16 through 30 are referred to hereinafter as the postliminary compartments. Each will hold more flash cards than are in a set of new cards studied for the first time at a drill session. At any given drill session for a given postliminary compartment, there will be (a) either no cards reviewed from that compartment or (b) only a portion of the flash cards in that compartment will be reviewed.

The number flash cards that are removed from a compartment will be the number of cards at the outlet of the compartment, on the foot 80 of the hoisting partition 62, which are about the same number of cards that were added after being taken from the adjacent compartment and reviewed. There is no precondition of uniformity between the number of cards added and the number of cards pushed to the outlet during the incipient period. During the steady state period, however, if there is no modification of the compartment's length, such a uniformity will have substantially developed. Such a uniformity, that is, the number of cards that are removed substantially equaling the number of cards added (presuming reasonable uniformity in card thickness) is referred to as the in-out uniformity ("IOU"). In a full steady state condition, each compartment of the management apparatus has reached an IOU state. If the same number of new flash cards are selected at every drill session, then there will be cards to review from every compartment at every drill session. If however the number of new cards introduced into the drill sessions is not constant, the full steady state is not reached, or if it had been reached it is then broken, and instead a partial or near steady state develops.

If the frequency of reviewing a card is to progressively decrease, each compartment must be shorter than the compartments beyond it in the sequence.

In preferred embodiment the length of each of the postliminary compartments in the sequence is approximately "x+y", wherein x is the length of the immediately adjacent prior postliminary compartment in the sequence and y is a constant. The first postliminary compartment in the sequence therefor, applying this formula, is "y", or in the alternative the sequence can start using a compartment length outside of this formula. The lengths of the compartments and the proportions between them can, however, be selected to provide any desired frequency pattern among the possible patterns provided by the management apparatus and its adjustability as to compartment length, for a given thickness of flash cards. In addition, the number times a card is reviewed can be decreased by eliminating one or more of the compartments from the sequence.

Figure 4:
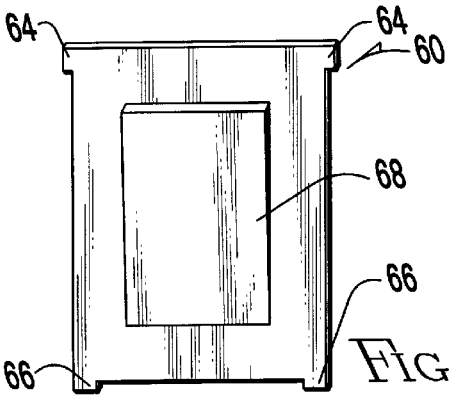
FIG. 4 is an enlarged front view of a first partition component of the flash card management apparatus of FIG. 1.
Figure 5:
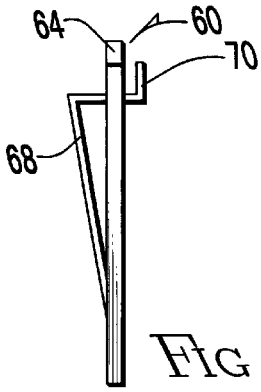
FIG. 5 is a side view of the partition component of FIG. 4.

Regarding the first partitions 60, reference is made also to FIG. 4 and FIG. 5. Each of the first or length-regulating partitions 60 as shown particularly in FIG. 4 and FIG. 5, is substantially rectangular and is formed with an upper pair of oppositely and horizontally-extending protrusions 64 and a lower pair of downward extending protrusions 66. A leaf spring 68 is mounted on the front side of the length-regulating partition 60. The spring 68 has a manual pull 70 that projects through the length-regulating partition 60. The spring pull 70 is thus operable from the back side of the first partition 60 opposite the spring 68. Each of the postliminary compartments has at least one upper and one lower pair of notches 72. The four notches 72 receive the complementary four protrusions 64,66 of a first partition 60. When a first partition 60 is set within a compartment, with its protrusions 64, 66 seated within the notches 72, the partition 60 is held at that position within the given compartment, and its position determines the effective length, or more aptly the maximum effective length, of the compartment. In preferred embodiment, a compartment has a plurality of four-notch sets that are positioned at intervals along its overall length, so that the effective length can be modified if desired by removal of the first partition 60 and its replacement at a different four-notch set. The combination of protrusions and notches are positioners and an adjustable first partition 60 is a compartment length regulator. Shorter postliminary compartments will decrease the time interval between reviews of a given flash card, and longer postliminary compartments will increase the time interval between reviews of a given flash card, presuming substantially the same number of new cards are introduced into the sequence at the drill sessions.

To add a set of flash cards to a given compartment, the leaf spring 68 of its first partition 60 is pulled back into close proximity to the partition 60, using the spring pull 70, and the flash cards are slid into the opened space. The pull 70 is released and the flash cards are moved or pressed forward.

Figure 6:
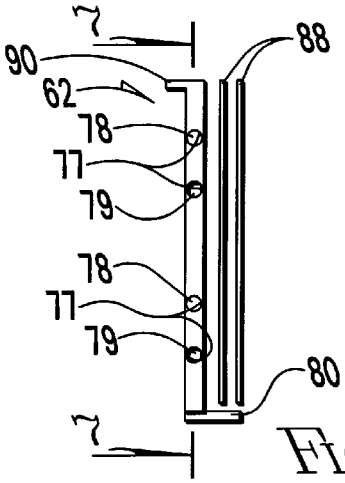
FIG. 6 is an enlarged, side view of a second partition component of FIG. 1.
Figure 7:
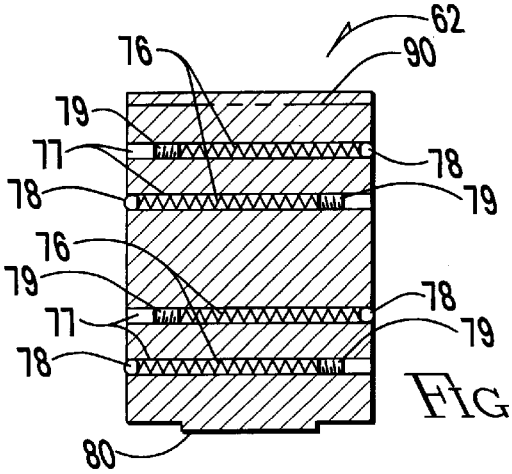
FIG. 7 is a sectional view of the partition component of FIG. 6, taken along line 7—7 of FIG. 6.

Referring now also to FIG. 6 and FIG. 7, there is shown a second partition 62 with four internal spiral springs 76 pressing four detent balls 78 outwardly of the partition's sides in alternating directions. Each of the detent balls 78 provide a slight degree of frictional contact with the inner sides of a compartment, and therefore provide a degree of detaining force that is readily overcome by pressure, such as the pressure of the build up of flash cards and the release of the spring pull 70 on the first partition 60. Each of the spiral springs 76 are mounted in substantially horizontally oriented apertures 77 and the springs 76 bear against set screws 79 at their ends opposite the detent balls 78. The detent balls 78 cannot move past the mouths of their respective apertures 77 in conventional fashion. The second partition 62 is substantially free to slide along the compartment as the flash cards build up behind it. The second partitions 62 will slide along their respective compartment until they abut the front walls thereof, and at that position the second partitions 62 are positioned for removal of flash cards.

The second or hoisting partition 62 has a foot member 80 that stabilizes the partition 62 in a upright position. The foot member 80 projects inward, towards the first partition 60. The foot member 80 is substantially centered relative the main body of the hoisting partition 62, and does not extend the entire width of the partition 62. When the partition 62 is set within a postliminary compartment, the foot member 80 rides in a guideway 82 formed in the bottom of the compartments. The guideway 82 as shown in FIG. 1 is formed by a pair of shoulders 84 forming a trough region 86 between them. (The flat-bottomed first partitions 60 thus actually sit on these shoulders 84 and the notches 66, 67 are formed in the shoulders 84.) The flash cards in the postliminary compartments will sit on the shoulders 84, and some will ride over (or overlie) the foot member 80 at least when the capacity of a given compartment is reached. The cards that overlie the foot member 80 when the respective second partition 62 has been pushed against the front wall of the respective compartment are the cards 88 at the compartment's outlet. The cards 88 at the outlet are removed by pulling the hoisting partition 62 upward, partially but not completely out of the compartment. As the second partition is raised, the foot member 80 rises out of the guideway 82 to the level of the other cards in the compartment and bears against that line of cards, preventing them from filling the gap left when the cards 88 overlying the foot member 80 are manually grasped and removed from the compartment. When the second or hoisting partition 62 is then lowered back into place, the foot member 80 returns to the trough 86 of the guideway 82, and the line of cards that remain in the compartment are then free to start filling in the gap left by the cards 88 that were removed.

Partition tabs or handles 90 project forward from the tops of the second partitions 62. These tabs or handles 90 provide a convenient finger hold for lifting the second or hoisting partitions 62 when cards are removed.

The flash card management apparatus 10 comprises a plurality of flash card compartments which each have a flash card retention capacity, namely the room or space to hold or accommodate a certain maximum number of flash cards. The actual value of such retention capacity in terms of the number of cards retained will of course depend not only on the available space but also the thickness of the cards. The concept of maximum retention capacity relates to the postliminary compartments 16 through 30, and not absolutely to the inaugural compartments 12, 14. The inaugural compartments 12, 14 do of course have a holding capacity, that is the maximum number of cards that can be inserted and stored within between drill sessions. The retention capacities of the postliminary type of compartments such as compartments 16 through 30, must of course be capacities for more than one flash card, while the holding capacities of any inaugural type of compartment, such as compartments 12, 14, must be capacities for at least one card. As shown in FIG. 1, the holding capacities of the inaugural compartments 12, 14 are each from about five to about thirty cards, and the retention capacities of the postliminary compartments ranges from about ten to about one hundred twenty cards for the lowest retention capacity compartment 16, to from about eighty to about one thousand sixty cards for the highest retention capacity compartment 30. The postliminary compartments 16 through 30 each are open, or one can say convertible to being open, for the intake of flash cards approaching or reaching their flash card retention capacity at an intake zone, that is in the area of the first partitions 60 whereat the leaf springs 68 in their normally released positions occupy the spaces immediately in front of, or ahead of, the partitions 60, and these spaces are open or available for the intake or receipt of additional flash cards when the springs 68 are pulled back against the partitions 60. When the springs 68 are released when the capacity of the compartment is reached or approached, some of the cards are being pushed to the outlet. An intake zone thus can be considered as including a spring 68 and a means to recoil the spring 68, which as shown is the spring pull 70.

For practical reasons, namely to keep the flash cards in a upright position, the second partition 62 should be maintained in a position as close to the first partition 60 as possible, and allowed to slide farther apart only as additional flash cards are added.

The postliminary compartments 16 through 30 each have a flash card outlet zone for the removal of flash cards, namely the second partitions 62 and the space immediately above the foot member 80 of the second or hoisting partition. Cards are preferably not removed from the outlet zone until the second partition is moved forward, away from the first partition 60 to the fullest extent possible, which will occur at or about the full capacity condition.

The postliminary compartments 16 through 30 thus can be said to each have a flash card maximal retention capacity, which is approximately the maximum number of cards that can be fitted in between the intake zone and the outlet zone, and a mutable retention capacity which is the maximum number of cards that can be fitted in between the first and second partitions 60, 62 (which of course depends on the space between). The maximal retention capacities of these compartments for a given thickness of flash cards would be the capacity between the intake zone and the outlet zone excluding cards that are removable at the outlet, measured with the leaf springs 68 in their released positions. All of the compartments 12 through 30 are ordered in a progression according to flash card capacities, with the inaugural compartments 12, 14 being of course of substantially the same holding capacities, and the postliminary compartments 16 though 30 being in a progression according to retention capacities. The flash card management apparatus 10 thus has postliminary compartments having different retention capacities, and at least one (two shown) inaugural compartment open to the manual insertion and removal of flash cards. The inaugural compartments 12, 14 each have a flash card holding capacity that is less than any of the retention capacities of the postliminary compartments 16 through 30.

Figure 3:
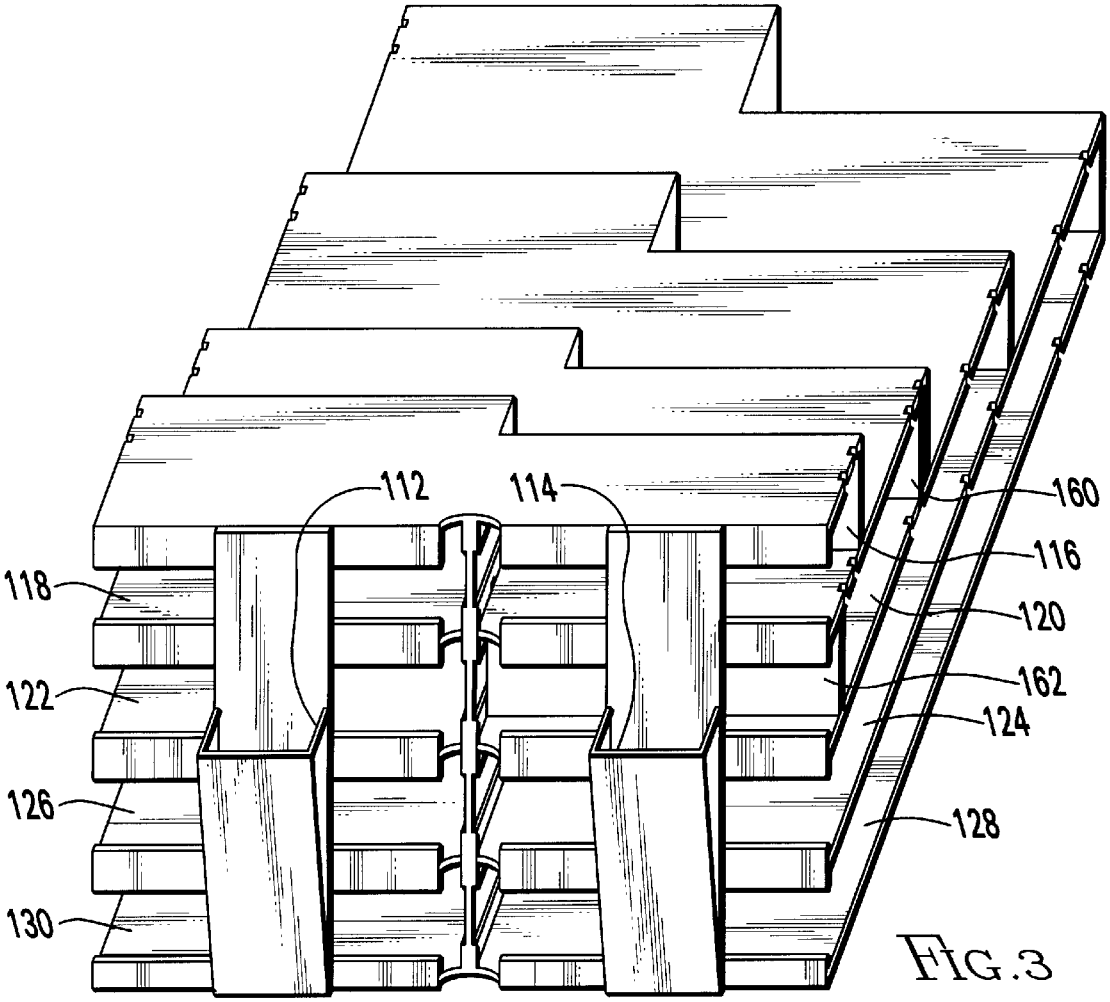
FIG. 3 is a perspective view of a flash card management apparatus of the invention.

In FIG. 3 there is shown another embodiment of a flash card management apparatus 110 of the present invention. The management apparatus has plurality of flash card compartments, namely compartments 112, 114, 116, 118, 120, 122, 124, 126, 128 and 130. As arranged in this embodiment, two of the ten compartments, namely compartment 112 and 114, face forward, each fronting a stacked series of four compartments. In more detail, compartment 112 is disposed in front of a vertical stack of compartments, which are from top to bottom are compartment 118, compartment 122, compartment 126 and compartment 130. Similarly, compartment 114 is disposed in front of a vertical stack of compartments, which are from top to bottom are compartment 116, compartment 120, compartment 124 and compartment 128. The lengths of the compartments 116 through 130 increases with alternately (side-to-side) and from top to bottom. The sequence follows the designation numbers, namely compartment 116 on the left side, and then to compartment 118 on the right side, and then to compartment 120 on the left side, and so forth. In this order, the compartments 116 to 130 form an arrangement of progressively longer compartments and thus compartments of progressively larger capacities for flash cards. Compartment 112 and compartment 114 are of substantially the same capacities. Compartment 112 and compartment 114 are the inaugural compartments of management apparatus 110. Compartments 116 through 130 are the postliminary compartments. Each of the postliminary compartments of the management apparatus 110 of FIG. 3 also should be equipped with first and the second partitions 160, 162 substantially like the partitions 60, 62 described above for FIG. 1, except appropriately modified as to configuration and dimensions. The cards are inserted and removed from the open sides of the compartments. The use and structure of the management apparatus 110 otherwise is substantially the same as management apparatus 10 described above, and the details are not repeated here.

Figure 8:
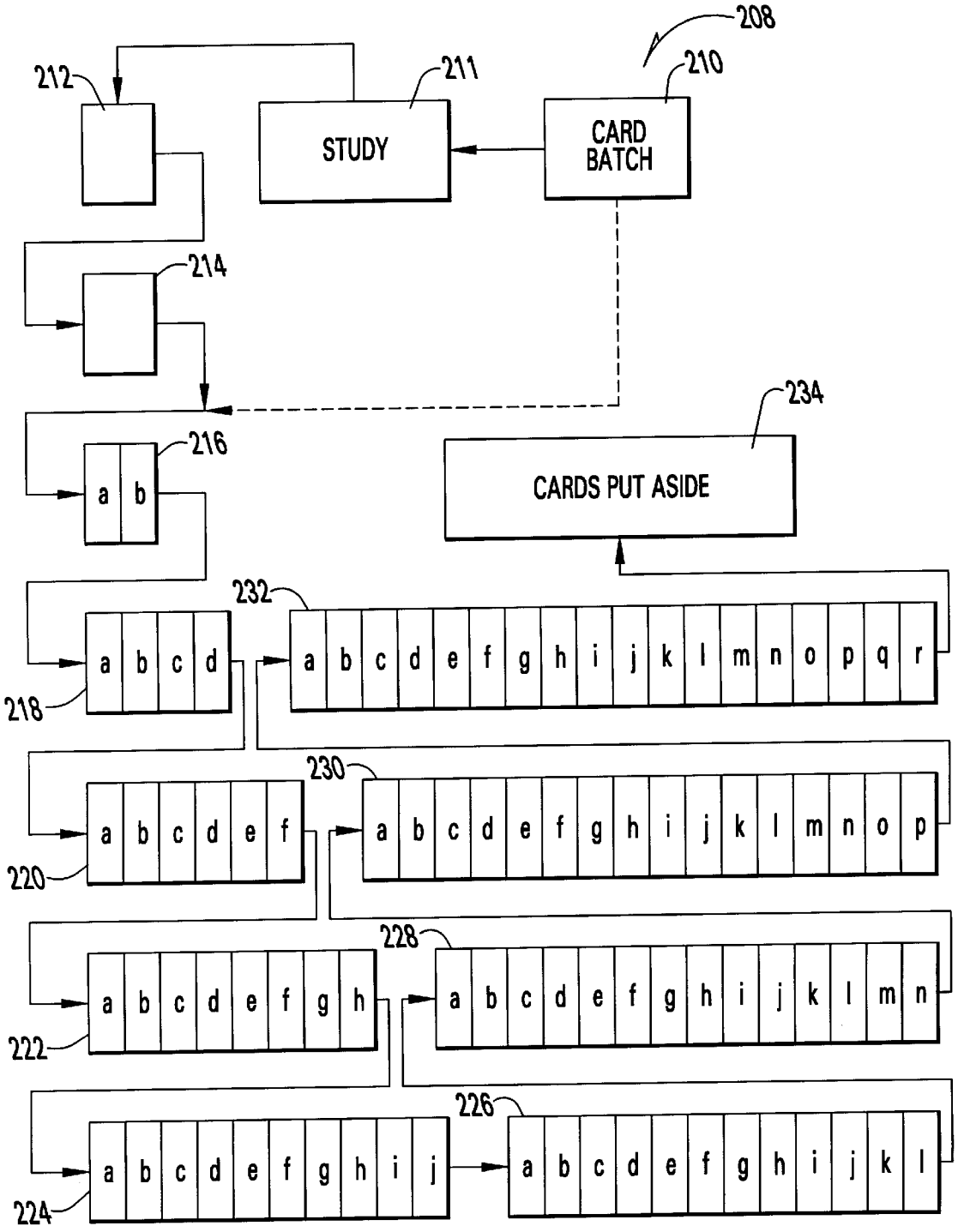
FIG. 8 is a flow diagram of a method of the present invention.

The present invention also is a learning drill session method using (A) the flash card management apparatus and (B) a batch of flash cards. Referring now to the flow diagram 208 of FIG. 8, using a flash card management apparatus with a plurality of postliminary compartments (as shown, nine postliminary compartment stations, namely compartment stations 216, 218, 220, 224, 226, 228, 230, and 232) and optionally at least one inaugural compartment (as shown, two inaugural compartment stations, namely compartment stations 212, 214), an embodiment of the method is illustrated. The various compartment stations are arranged in flow diagram 208 according to their ordered progression by compartment capacities. Inaugural compartment stations 212 and 214 have the same capacities, and only in such an instance is their placement in the ordered progression arbitrary. The capacities of the postliminary compartments are illustrated in FIG. 8 by the sections of the station, each section representing a capacity for five cards. The first section of each postliminary compartment station, namely the leftmost section designated by the letter "a" represents the respective intake zone, and the last section of each postliminary compartment station, namely the right-most section designated by the letters "b", "d", "f" and so forth, represent the respective outlet zone. The inaugural compartments shown at stations 212 and 214 have a capacity for more than five cards, but in use only five cards are stored therein at a given time. In this example each set of new cards will be a five-card set.

The following definitions apply to the short-forms used below. The $p_x$ postliminary compartment is, in a given step 2 sequence, the highest capacity postliminary compartment within the ordered progression (i) in which there are cards at the outlet zone and (ii) from which cards have not already been removed pursuant to a sub-step 2*a*. The $p_{x+1}$ postliminary compartment is the postliminary compartment of next highest capacity in the ordered progression. The $p_n$ postliminary compartment is the first postliminary compartment in the ordered progression (which of course will be the postliminary compartment of the lowest capacity). The $i_x$ inaugural compartment is the highest inaugural compartment within the ordered progression from which no cards have been yet removed in the given step 2 sequence. The $i_{x-+1}$ inaugural compartment is the next higher inaugural compartment in the ordered progression.

The method comprises the steps of:

(step 1) Select and study a set of cards from the batch of flash cards at new-card station 210, which is shown in FIG. 8 as the movement of cards between the batch of cards station 210 and the study station 211. Then place the set in the lowest compartment of the ordered progression. If there were no inaugural compartment stations, the lowest compartment would be the postliminary compartment at station 216. The theoretical transfer of cards from the study station 211 to the postliminary compartment station 216 is shown by dotted line. For this dotted line route to the lowest postliminary compartment, the set is placed adjacent the first partition of and behind any cards already within the lowest postliminary compartment, which is shown in FIG. 8 by the routing of the set to the first section, section "a" of station 216. In actuality, since two inaugural compartment stations are present, the set is routed to station 212, the station for the lowest inaugural compartment in the progression.

Referring to the set of cards studied and stored in step 1 as set-1, FIG. 8 can be used to follow set-1 through multiple drill sessions, each drill session comprising steps 1 and 2, in a hypothetical in which the above step 1 was the very beginning of the incipient period. Set-1 moves through the compartment stations from station 212 to station 214, then to section "a" of station 216, then to section "b" of station 216, then to section "a" of station 218, and so forth, each move occurring in successive drill sessions. Set-1 is studied at the first drill session, reviewed at the second and third drill sessions at stations 212 and 214 respectively, and then again at the fourth drill session (when removed from section "b" of station 216) and the eighth drill session (when removed from section "d" of station 218) and the fourteenth drill session (when removed from section "f" of station 220) and so forth. Also seen is that at the fourteenth drill session, sets of cards are removed for review at station 220, 218, 216, 214 and 212, but none from the compartment stations above station 220 in the ordered progression.

(step 2) The presumption is that a steady state has not been reached, and instead there have been only three sets of cards that previously have been removed from station 228 and placed into station 230. A portion of the cards within the compartments are reviewed by the following sub-steps.

(sub-step 2a ) Cards are removed from the outlet zone of the $p_x$ postliminary compartment. The $p_x$ postliminary compartment is defined as being, in a given step 2 sequence, the highest capacity postliminary compartment within the ordered progression (i) in which there are cards at the outlet zone and (ii) from which cards have not already been removed pursuant to a sub-step 2a, which in this example would be station 228 which has a set of cards in its right-most or last section "n".

(sub-step 2b) The cards removed from section "n" of station 228 are reviewed (which is not shown as a separate station in FIG. 8).

(sub-step 2c) The cards removed from section "n" of station 228 in sub-step 2a and the reviewed in sub-step 2b, are placed in the $p_{x+1}$ postliminary compartment. The $p_{x+1}$ postliminary compartment is the next highest compartment in the ordered progression, which is the compartment at station 230. The reviewed cards are placed adjacent the first partition of the $p_{x+1}$ postliminary compartment as represented by section "a" at station 230 and behind any cards already within the $p_{x+1}$ postliminary compartment. If there were no $p_{x+1}$ postliminary compartment, for instance if the reviewed cards had come from station 232, then the cards would be set aside represented at station 234.

(sub-step 2d) Sub-steps 2a through 2c are then repeated on cards in turn from the outlet zone of the next $p_x$ postliminary compartments until there is no $p_x$ postliminary compartment. Again, the $p_x$ postliminary compartment is defined as being, in a given step 2 sequence, the highest capacity postliminary compartment within the ordered progression (i) in which there are cards at the outlet zone and (ii) from which cards have not already been removed pursuant to a sub-step 2a. Since cards have been removed from compartment station 228 pursuant to a sub-step 2a, the next $P_x$ postliminary compartment station is station 226. Station 228 is no longer a $p_x$ postliminary compartment in this step 2 sequence, and stations 218 through 224 are not yet, but will become, $p_x$ postliminary compartment stations. Therefore sub-steps 2a through 2c are performed with the $p_x$ postliminary compartment of station 226. Then pursuant to this sub-step 2d in like manner sub-steps 2a through 2c will be performed with the $p_x$ postliminary compartment at station 224, and then station 222, station 220, station 218 and finally station 216. After sub-steps 2a through 2c are performed with the Px postliminary compartment at station 216, no further compartment can meet the definition of a $p_x$ postliminary compartment in this step 2 sequence. (sub-step 2e) Then cards are removed from the $i_x$ inaugural compartment of the ordered progression. The $i_x$ inaugural compartment is the highest inaugural compartment within the ordered progression from which no cards have been yet removed in the given step 2 sequence, which is the compartment of station 214. Therefore at station 214 all the cards are removed, reviewed and then placed in the $p_n$ postliminary compartment, which is defined as the first postliminary compartment in the ordered progression, and which here is the compartment at station 216.

(sub-step 2f) Then the cards in the $i_x$ inaugural compartment of the ordered progression, are removed, reviewed and placed in the $i_{x\ 30\ 1}$ inaugural compartment. The $i_x$ inaugural compartment is the highest inaugural compartment within the ordered progression from which no cards have been yet removed in the given step 2 sequence, which here is the compartment at station 212. The $i_{x+1}$ inaugural compartment is the next highest inaugural compartment in the ordered progression, which is the compartment at station 214.

(sub-step 2g) If there was one or more inaugural compartments lower than the compartment at station 212 then the highest would be, for purposes of this sub-step, the next $i_x$ inaugural compartments upon which sub-step 2f is performed, and so forth until no inaugural compartment meets the definition of an $i_x$ inaugural compartment in this step 2 sequence.

It is seen from the above that step 1 and step 2 in combination constitute a single drill session, and that such combination of steps is repeated for each drill session.

As illustrated in this embodiment of the method, in any given drill session the student can study new cards (step 1) first, or last, or even in between the various sub-steps of the review (step 2). It would generally be impractical, however, but not impossible, to vary the sequence of the review sub-steps (sub-steps 2a through 2g). In the review sub-steps the group of cards removed from one compartment will always be transferred to the next highest compartment of the ordered progression according to length, or in other words, according to card capacity.

When the flash card management apparatus includes a leaf spring mounted on the first partition, movable from a normal released orientation to a retracted orientation, which projects forward from the first partition when in its the released orientation, and lies in substantially co-planar alignment with the first partition when in its the retracted orientation, sub-step 2c further includes the maneuver of moving the spring leaf to its the retracted orientation whereby space is provided to place the reviewed cards adjacent the first partition of the $p_{x+1}$ postliminary compartment and behind any cards already within the $p_{x+1}$ postliminary compartment.

When the flash card management apparatus includes a bottom guideway in at least one of the postliminary compartments and a foot member attached to at least one of the second partitions, wherein the foot member is normally positioned within the bottom guideway and runs along the guideway upon the translation of the second partition, and wherein guideway is open for a substantially vertical lifting of the foot member out of the guideway, sub-step 2a further includes the maneuvers of raising the second partition together with the cards on the foot member partially out of the $p_x$ postliminary compartment and manually removing the cards on the foot member whereby the cards are removed from the outlet zone of the $p_x$ postliminary compartment. In the illustration above using FIG. 8, where each set of new cards contains "n" number of cards, and the capacities of each postliminary compartment are multiples of "n", the foot member should hold about "n" number of cards, so that about the same number of cards are removed as are added in each implementation of sub-step 2a. There need not be absolute IOU uniformity, and as can be readily envisioned, there probably will not be absolute IOU uniformity.

When the position of the first partition of at least one of the postliminary compartments is adjustable from a first position to at least a second position, the method further may include the step 3 of adjusting the first partition of at least one of the postliminary compartments between the first position and the second position.

The method is particularly advantageous when the flash cards are vocabulary flash cards.

A management apparatus of the present invention has a plurality of postliminary compartments. In preferred embodiment a management apparatus of the present invention has from about four to about sixteen postliminary compartments, and more preferably from about six to about twelve postliminary compartments. In most preferred embodiment, a management apparatus of the present invention has about eight postliminary compartments.

In preferred embodiment, a management apparatus of the present invention has a plurality of inaugural compartments, and in more preferred embodiment from about 1 to about four inaugural compartments. In most preferred embodiments a management apparatus has two inaugural compartments.

It is well within the skill of a person in the technical field, upon becoming conversant with, or otherwise having knowledge of, the present invention, to select suitable combinations of compartments and settings and the like in view of the type of management apparatus being designed and/or constructed.

The above described embodiments are exemplitive, and the terminology is employed for illustration purposes and not limitation purposes. The present invention is not limited to the combinations and subcombinations illustrated herein.

I claim:

1. A flash card management apparatus comprising:

a plurality of flash card postliminary compartments, said postliminary compartments each having a flash card retention capacity for a plurality of flash cards, said flash card retention capacity being the maximum number of flash cards which can be held within said postliminary compartment;

said postliminary compartments each being open or convertible to being open for the intake of flash cards in excess of their flash card retention capacity at an intake zone;

said postliminary compartments each having a flash card outlet zone including means for the ejection of flash cards which exceed said flash card retention capacity;

said postliminary compartments each having a flash card retention zone in between and open to said intake zone and said outlet zone; and said intake zone including means for urging flash cards from said intake zone into said retention zone and from said retention zone into said outlet zone, whereby the intake of flash cards at said intake zone drives flash cards into said outlet zone, the number of flash cards in the retention zone remaining substantially the same.

2. The flash card management apparatus of claim 1 wherein said postliminary compartments are ordered in a progression according to retention capacities.

3. The flash card management apparatus of claim 1 wherein said intake zone includes a spring and means for recoiling said spring.

4. The flash card management apparatus of claim 1 wherein said outlet zone includes a means for removal of a portion of cards.

5. The flash card management apparatus of claim 1 wherein said postliminary compartments have different retention capacities; and further including at least one inaugural compartment open to the manual insertion and removal of flash cards, said inaugural compartment having a substantially constant flash card holding capacity that is less than any of said retention capacities of said postliminary compartments.

6. The flash card management apparatus of claim 5 wherein said postliminary compartments are ordered in a progression according to retention capacities, wherein said intake zone includes a spring and means to recoil said spring, and wherein said outlet zone includes an area that overlies a card-removing foot member.

7. The flash card management apparatus of claim 6 wherein said apparatus has from about six to about twelve postliminary compartments and about two inaugural compartments.

8. The flash card management apparatus of claim 6 wherein the length of each of said postliminary compartments is approximately "x+y", wherein x is the length of the adjacent prior postliminary compartment in the sequence and y is a constant.

9. A flash card management apparatus comprising:

a series of postliminary compartments ordered in a progression of effective lengths, said compartments having maximal flash card retention capacities determined by said effective lengths, said maximal flash card retention capacity being the maximum number of flash cards which can be held within said postliminary compartment;

said postliminary compartments each having a first and a second partition, wherein said second partition is translatable between a first position near said first partition to a second position at a flash card outlet zone, said effective lengths being determinable by the distance between said first and said second partitions when said second partition is in its second position; and said management apparatus further including means for ejecting flash cards from each of said compartments at said outlet zone.

10. The flash card management apparatus of claim 9 wherein said management apparatus further includes at least one inaugural flash card compartment having a flash card holding capacity that is less than any of said maximal flash card retention capacities of said postliminary compartments.

11. The flash card management apparatus of claim 10 wherein at least one of said postliminary compartments is an adjustable postliminary compartment and the position of said first partition of said adjustable postliminary compartment is adjustable from a first position to at least a second position, and wherein said effective length and said maximal retention capacity of said compartment is less when said first partition is in its second position than when said first partition is in its first position.

12. The flash card management apparatus of claim 11 wherein said postliminary compartments and said inaugural compartments are of substantially said same height and width, each having a vertical profile suited to holding flash cards in an upright position; and wherein each of said postliminary compartments is of a sufficient effective length to hold many flash cards.

13. The flash card management apparatus of claim 11 further including:

a leaf spring mounted on said first partition, said leaf spring being movable from a normal released orientation to a retracted orientation, said leaf spring projecting forward from said first partition when in its said released orientation, and said leaf spring lying in substantially co-planar alignment with said first partition when in its said retracted orientation;

a bottom guideway in at least one of said postliminary compartments; and a foot member attached to at least one of said second partitions, wherein said foot member is normally positioned within said bottom guideway and runs along said guideway upon said translation of said second partition, and wherein guideway is open for a substantially vertical lifting of said foot member out of said guideway.

14. The flash card management apparatus of claim 11 further including a plurality of vocabulary flash cards.

15. A flash card management apparatus comprising:

a series of postliminary compartments;

said postliminary compartments each having a first partition and a spring mounted on said first partition, said spring being movable from a normal extended orientation to a compressed orientation, said postliminary compartments each having a second partition spaced apart from said first partition;

a plurality of flash cards held within each of said postliminary compartments between said first and second partitions, and said second partitions each having a foot member facing said first partition, and said second partitions each being removable from said postliminary compartments by vertical lifting.

16. The flash card management apparatus of claim 15, further including a bottom guideway in each of said postliminary compartments;

said second partitions being translatable along said guideways;

said foot members normally positioned within said guideways and running along said guideways upon said translation of said second partitions, said guideways each being open at a point remote from said first partition for a substantially vertical lifting of said foot member out of said guideway.

17. The flash card management apparatus of claim 15, further including at least one inaugural flash card compartment having a flash card holding capacity that is less than that of any of said postliminary compartments.

18. The flash card management apparatus of claim 15 wherein said postliminary compartments and said inaugural compartments are of substantially said same height and width, each having a vertical profile suited to holding flash cards in an upright position; and wherein each of said postliminary compartments is of a sufficient effective length between said first and second positions to hold many flash cards.

* * * * *